US011482096B2

(12) United States Patent
Haug

(10) Patent No.: US 11,482,096 B2
(45) Date of Patent: Oct. 25, 2022

(54) REMOTE-CONTROL ARRANGEMENT AND METHOD FOR OPERATING THE REMOTE-CONTROL ARRANGEMENT

(71) Applicant: Thomas Haug, Birkenfeld (DE)

(72) Inventor: Thomas Haug, Birkenfeld (DE)

( * ) Notice: Subject to any disclaimer, the term of this patent is extended or adjusted under 35 U.S.C. 154(b) by 0 days.

(21) Appl. No.: 17/252,846

(22) PCT Filed: Jul. 16, 2019

(86) PCT No.: PCT/EP2019/069127
§ 371 (c)(1),
(2) Date: Dec. 16, 2020

(87) PCT Pub. No.: WO2020/020707
PCT Pub. Date: Jan. 30, 2020

(65) Prior Publication Data

US 2021/0134145 A1 May 6, 2021

(30) Foreign Application Priority Data

Jul. 26, 2018 (DE) ..... 10 2018 118 135.3

(51) Int. Cl.
*G08C 17/02* (2006.01)
*B66C 13/40* (2006.01)

(52) U.S. Cl.
CPC ..... *G08C 17/02* (2013.01); *B66C 13/40* (2013.01); *G08C 2201/30* (2013.01); *G08C 2201/50* (2013.01)

(58) Field of Classification Search
CPC ..... G08C 17/02; G08C 2201/30; G08C 2201/50; B66C 13/40; B25F 5/00; G06F 1/1632
See application file for complete search history.

(56) References Cited

U.S. PATENT DOCUMENTS 5,889,671 A * 3/1999 Autermann ..... G05B 19/409 700/83
9,063,526 B2 * 6/2015 Yamamoto ..... G05B 17/02
(Continued)

FOREIGN PATENT DOCUMENTS

DE 10 2008 025 632 A1 12/2009
DE 20 2017 104 769 U1 10/2017
(Continued)

OTHER PUBLICATIONS

International Search Report, issued in PCT/EP2019/069127, dated Oct. 10, 2019.

*Primary Examiner* — Adnan Aziz
(74) *Attorney, Agent, or Firm* — Birch, Stewart, Kolasch & Birch, LLP

(57) ABSTRACT

A remote-control arrangement for remotely controlled objects, such as in particular lifting systems and/or working devices, has a handheld transmitter which has a housing on which multiple adjustable-position operating elements for the input of control commands are held, and in which remote control electronics are accommodated, by means of which control commands input via the operating elements can be converted into signals, which can be emitted to control the objects, and a display held on the housing for displaying control-relevant information. The display is formed by a computer display of a portable computer produced separately from the transmitter, and a standard interface, via which the portable computer can be detachably connected to the remote-control electronics of the transmitter, is provided on the housing.

17 Claims, 2 Drawing Sheets

(56) References Cited

U.S. PATENT DOCUMENTS

Figure 1:
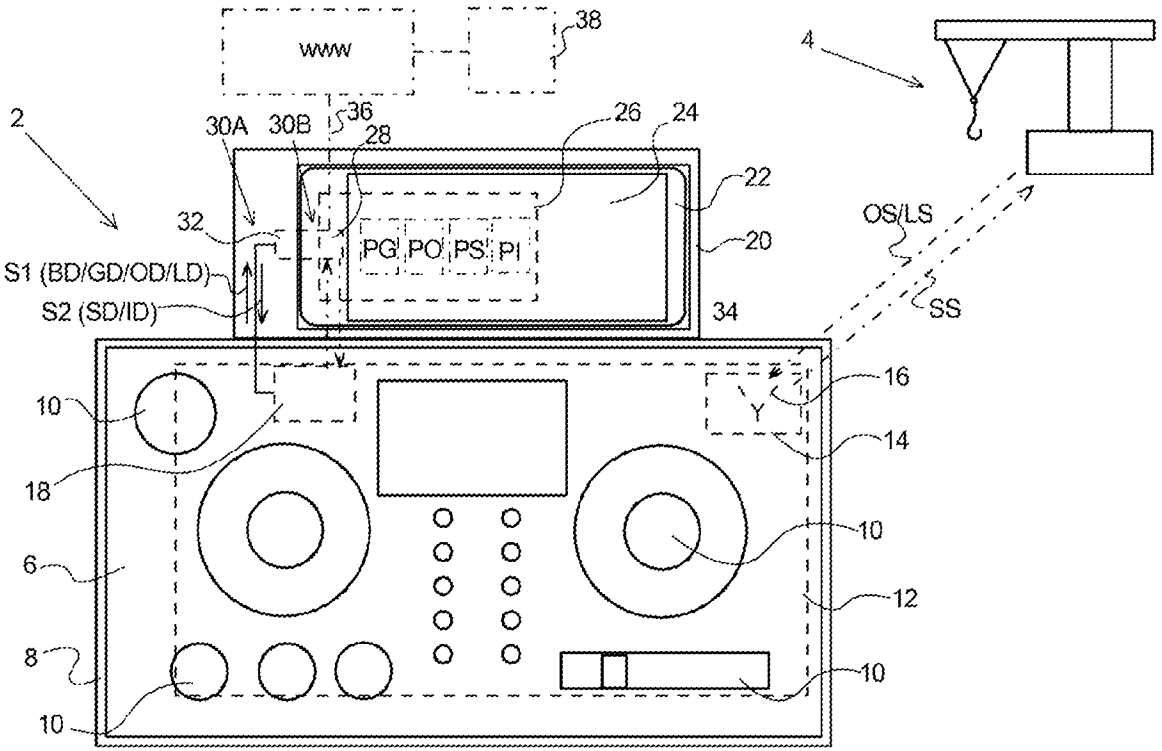

| | | | | |
|---|---|---|---|---|
| 9,078,342 | B2 * | 7/2015 | Eul | E01C 19/48 |
| 9,108,689 | B1 * | 8/2015 | Shelby | B60K 37/04 |
| 10,291,762 | B2 * | 5/2019 | Andersen | H04M 1/72409 |
| 10,779,457 | B2 * | 9/2020 | Barzen | B60K 35/00 |
| 2003/0090480 | A1 * | 5/2003 | Polgar | G06F 1/1626 345/82 |
| 2006/0045620 | A1 * | 3/2006 | Olson | E01C 19/48 404/84.1 |
| 2009/0212905 | A1 * | 8/2009 | Batz | G07C 9/00944 340/5.54 |
| 2010/0097239 | A1 * | 4/2010 | Campbell | B60R 11/0252 340/4.4 |
| 2010/0250815 | A1 * | 9/2010 | Street | G06F 1/1632 710/303 |
| 2011/0178677 | A1 * | 7/2011 | Finley | E02F 9/265 701/31.4 |
| 2012/0015686 | A1 * | 1/2012 | Krupnik | G06F 3/04883 455/550.1 |
| 2012/0137038 | A1 * | 5/2012 | Huang | G06F 1/1632 710/303 |
| 2012/0143445 | A1 * | 6/2012 | Morath | E02F 9/205 701/50 |
| 2014/0240125 | A1 | 8/2014 | Burch et al. | |
| 2016/0132052 | A1 * | 5/2016 | Seydoux | G08C 17/02 701/2 |
| 2016/0161989 | A1 | 6/2016 | Prejer et al. | |
| 2016/0217684 | A1 * | 7/2016 | Bossier | G08C 17/02 |
| 2016/0266610 | A1 * | 9/2016 | Nessel | B60K 35/00 |
| 2017/0154006 | A1 * | 6/2017 | Tuccinardi | B60K 37/04 |
| 2018/0359792 | A1 * | 12/2018 | Jensen | G08G 5/0069 |
| 2019/0284027 | A1 | 9/2019 | Albrecht | |
| 2020/0361752 | A1 * | 11/2020 | Krebs | G08C 17/02 |

FOREIGN PATENT DOCUMENTS

| | | | |
|---|---|---|---|
| DE | 10 2016 012 786 | A1 | 4/2018 |
| EP | 1 308 825 | A1 | 5/2003 |
| EP | 2 138 985 | A2 | 12/2009 |
| EP | 3 067 774 | A1 | 9/2016 |
| GB | 2460326 | A | 12/2009 |
| JP | 2014-125321 | A | 7/2014 |
| WO | WO 2014/127822 | A1 | 8/2014 |

* cited by examiner

REMOTE-CONTROL ARRANGEMENT AND METHOD FOR OPERATING THE REMOTE-CONTROL ARRANGEMENT

DESCRIPTION

The invention relates to a handheld or portable remote-control arrangement, in particular for controlling and operating lifting systems and industrial or agricultural apparatuses, according to the preamble of claim 1, as well as a method for operating one such remote-control arrangement. The remote-control arrangement has in this regard a transmitter in the form of a handheld remote-controlled transmitter having a housing on which are held multiple operating elements, which are adjustable in their position, for inputting control commands. In addition, remote-control electronics are accommodated in the housing by means of which control commands inputted via the operating elements can be transformed into signals which are transmitted for controlling an object. Furthermore, the remote-controlled arrangement has a display held on the housing which serves to display control-relevant data.

From EP2138985A1 is known a remote-control arrangement which has a housing on which are provided several operating elements and which accommodates remote-control electronics. Additionally, a display is arranged centrally on the top side of the housing which serves for displaying control-relevant data.

It is a disadvantage of such remote-control arrangements that the remote-control electronics and the display are permanently connected with one another and are mutually coordinated. As a result, changes to be undertaken to the remote-control electronics, such as in particular newly added functions, are frequently not sufficiently displayed on the display. The other way around, it is however usually not possible or possible only with significant effort to use a new display which offers for example new display options or an improved reproduction quality. As a result, in particular when there are new developments for one such remote-control arrangement, the necessary adaptation of the control electronics to a new display results in relatively high costs.

It is the task of the invention to avoid the mentioned disadvantages in the case of a remote-control arrangement according to the invention and to facilitate a more comfortable extension of functions or display, as well as more varied application possibilities.

This task is solved by a remote-control arrangement having the characteristics of claim 1. In this regard, the display is formed by a computer display of a portable computer, such as for example in the form of a smart phone or tablet computer, manufactured separately from the transmitter and provided externally to the housing. In addition, on the housing is provided a standard interface by means of which the portable computer can be releasably connected with the electronics of the transmitter. In this manner it is possible to use an exchangeable conventional computer at least for parts of the information to be displayed on the transmitter. Thus, after a long period of use, the transmitter can be equipped with a new display by using a new portable computer, in order for example to improve the display of information or to make available display functions which are fundamentally new. Since the portable computer has its own processor it is in addition especially simple to adapt the remote-control electronics of the transmitter to the display of the portable computer, or to exchange additional information between two control units. It is also possible for the user to use a portable computer which is already available to him, as a result of which the costs for the new display can be minimised.

In an especially advantageous embodiment, the standard interface is bidirectional in design, such that at said standard interface first signals can be transmitted from the remote-control electronics to the processor and second signals can be transmitted from a processor of the portable computer to the remote-control electronics of the transmitter. In addition to the transmission of signals from transmitter to portable computer, such as in particular for displaying control-relevant data on the display, thus also signals can be transmitted from the portable computer to the remote-control electronics. In this manner, the remote-control arrangement facilitates entirely new functions, which for example require a mutual communication between the devices. For example, in this manner, programs can be used or saved on the portable computer which automatically trigger the transmission of certain data from the transmitter to the portable computer or vice versa, in order for example to undertake a device analysis, a repair or an adjustment of the transmitter.

It is here useful when the first signals contain image data in a common graphic standard for visualising the control relevant data on the computer display. In this manner, the control-relevant data generated by the transmitter can be displayed on a large number of different portable computers or displays.

Advantageously, the first signals include device data for carrying out a device analysis at the processor. In addition to the display function by means of the display, the portable computer can hereby be used also for maintenance or service purposes. Here, in addition, the computer can be used to transmit the device data for service or repair purposes to a service point or a manufacturer, such as for example via an Internet connection.

In a further advantageous embodiment, the second signals contain control data for the control of the remotely controlled object. It is thus possible to undertake a controlling of the object also from the portable computer via the transmitter. For example, various control manoeuvres can be stored on the portable computer which can be activated where required. In this regard, appropriate control data are outputted to the transmitter, which, depending on these control data, in turn transmits corresponding control signals to the remotely controlled object. Thus, an automated or semi-automated control of the object is possible by means of the portable computer.

It is in addition useful for the second signals to contain information data for adjusting at least one changeable value of the transmitter. Thus, particularly settings of a transceiver, such as for example with regard to the transmission frequency or the transmission power, can be especially simply set or altered on the transmitter.

Advantageously, the standard interface has a plug-in connection in order to guarantee an especially stable data transmission in both directions. For this purpose, for example a PCI-bus, USB or SCSI interface can be used.

Alternatively, it is useful for the standard interface to be wireless in design, such as for example by means of a Bluetooth, IrDA or WLAN interface. In this manner, an especially simple and comfortable separation and connection of the portable computer with respect to the transmitter is possible, such as for example when exchanging the display.

Furthermore, it is useful when the remote-control electronics of the transmitter have, in addition to a releasable connection with the portable computer, a permanent connection with a stationary display permanently installed in the housing, as a result of which parts of the information made available can be displayed directly on the transmitter independently of the portable computer.

Advantageously, a holder for the releasable fastening of the portable computer is provided on the housing, as a result of which a stable fixing of the portable computer and the transmitter can be guaranteed.

Furthermore, the mentioned task can be solved by a method for operating a remote-control arrangement in one of the embodiments described above, in which in a first step the portable computer is fixed to the housing of the transmitter and a bidirectional data connection is established between the remote-control electronics of the transmitter and the processor of the portable computer via the standard interface. The bidirectional connection here facilitates new functions for the remote-controlled arrangement.

Advantageously, in a second step, first signals are transmitted from remote-control electronics to the processor and, in a third step, second signals are transmitted from the processor to the control electronics, wherein both steps can be carried out one after another or also simultaneously. Thus, a mutual communication is facilitated between the remote-control electronics of the transmitter and the processor of the portable computer.

Preferably, the first signals contain image data created in a graphic standard, by means of which a visualisation of control-relevant data is generated on the computer display. The transmission of standardised image data here facilitates the display of the information generated by the transmitter on a commercially available display which is especially suitable for the intended field of application.

Advantageously, the first signals contain device data of the control device by means of which a functional analysis of the transmitter is carried out on the part of the portable computer. The transmission of the device data to the portable computer here facilitates an especially comprehensive functional analysis which can be carried out either by a program stored on the computer or after forwarding via the Internet on the part of a service point.

In addition, it is advantageous when the first signals contain object data of the remotely controlled object, by means of which a functional analysis of the remotely controlled object can be carried out. The object data are in this regard received on the part of the transmitter from the remotely controlled object and forwarded to the portable computer. The evaluation of the object data can then in turn be carried out by a program stored on the computer or after forwarding via the Internet on the part of a service point.

Furthermore, it is useful when the first signals contain live image data of the remotely controlled object, by means of which live images captured at the remotely controlled object are generated on the computer display. Thus, it is for example possible for the user of the control arrangement to view a working region of the object from a more suitable position while the object is being remotely controlled.

In an especially suitable embodiment of the method, the second signals contain information data by means of which adjustments can be undertaken on the transmitter or on the remotely controlled object. Thus, both the transmitter and the remotely controlled object can be adjusted via the portable computer or be configured for predefined applications. To this end, the information data can be transmitted from the processor to the control electronics, which, depending thereon, as appropriate transmits corresponding information signals to the remotely controlled object in turn. The information data can here either be saved permanently on the portable computer, or be uploaded via this portable computer for example by means of an Internet connection.

In a further preferred embodiment of the method, the second signals contain control data by means of which a control of the remotely controlled object can be undertaken. As already described above, thus specific control manoeuvres can be carried out in an automated or semi-automated manner. For this purpose, the control data are transmitted by the processor to the control electronics, which, depending thereon, transmit in turn corresponding control signals to the remotely controlled object. The control data of the individual manoeuvres can also in this case either be saved permanently on the portable computer or be uploaded via this portable computer by means of an Internet connection.

Furthermore, the stated task can be solved by a computer program product to be saved on a portable computer, which is solved for controlling an operational method in one of the above-mentioned embodiments. The computer program product can here be selected preferably from several application programs which are made available to the user as required via an Internet platform for downloading onto the portable computer. Thus, the user of the remote-control arrangement can adapt it especially comfortably to the application which is envisaged in each case and set up additional functions.

Attention is drawn to the fact that all above described characteristics of the subject-matter according to the invention can be exchanged or be combined among themselves, inasmuch as an exchange or a combination thereof is not excluded for technical reasons.

In the figures is shown an exemplary embodiment of the invention.

Figure 2:
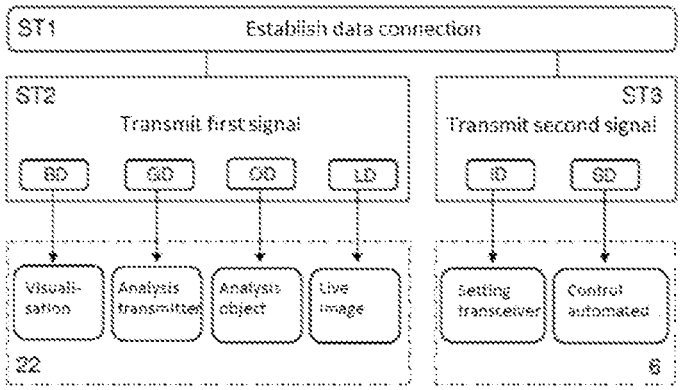

FIG. 1 shows a view of a remote-control arrangement according to the invention and FIG. 2 shows a diagram of the procedure of an operational method according to the invention.

FIG. 1 shows a remote-control arrangement 2 which serves to remotely control an object 4 in the form of any type of lifting system or another type of, particularly industrial or agricultural, working machine. To this end, the remote-control arrangement 2 has a transmitter 6 having a housing 8. On the housing 8 are provided multiple operating elements 10 in the exemplary form of joysticks, buttons, rotary controls and sliding controls, which serve for inputting control commands on the part of a user.

Within the housing 8 are accommodated remote-control electronics 12 which have a transceiver unit 14 having an antenna 16 and an interface device 18 on the transmitter side. The remote-control electronics 12 serve in this regard to convert the control commands inputted by way of the operating elements 10 into control signals SS, which can be transmitted via the transceiver unit 14 and the antenna 16 to the object 4 to be controlled.

As can furthermore be learned from FIG. 1, a holder 20 is additionally mounted on the housing 8, which holder serves for the releasable but stable fixing of a portable computer 22. This is formed for example by a smart phone or a tablet computer having an in particular touch-sensitive computer display 24 and a processor 26. In this regard, the processor 26 has an interface device 28 on the computer side.

The interface device 18 on the transmitter side and the interface device 28 on the computer side are configured such that they form a standard interface 30A which can be established via a plug-in connection 32. Alternatively or additionally to this, a wireless standard interface 30B can be established between the interface devices 18, 28, as is shown by dot-dashed arrows. The standard interface 30A which can be established via the plug-in connection 32 can in this case for example be in the form of a PCI-bus, USB or SCSI interface and the wireless standard interface can be in the form of a Bluetooth, IrDa or a WLAN interface.

In each case, the standard interface 30A; 30B functions bidirectionally and transmits first signals S1 from the remote-control electronics 12 of the transmitter 6 to the processor 26 of the portable computer 22, as well as second signals S2 from the processor 26 to the remote-control electronics 12.

The first signals S1 can in this regard contain image data BD created in a common graphic standard which serve for visualising information on the computer display 24. The visualised information can for example represent a charging state or a transmission power of the transmitter 6. Additionally or alternatively to the representation on the computer display 24, certain information can furthermore be displayed on a stationary display 34, according to FIG. 1, which is mounted directly on the housing 8 and has a permanent connection with the remote-control electronics 12. In this manner, the information concerned can be displayed independently of whether the portable computer 22 is connected with the transmitter 6 or not.

In addition, the first signals S1 can contain device data GD, by means of which, for example, an analysis of the settings or of the functionality of the transmitter 6 can be carried out at the processor 26. To this end, an appropriate computer program product is saved on the processor 26 in the form of an application program PG. Alternatively, it is also possible to forward the device data GD by way of an Internet connection 36 of the portable computer 22 to a service point 38 which can then carry out the device analysis.

Furthermore, the first signals S1 can contain object data OD which can be derived by the remote-control electronics 20 from object signals OS which the remotely controlled object 4 transmits to the transmitter 6. By means of these object data OD, for example an analysis of the settings or of the functionality of the object 4 can be carried out at the processor. To this end, an appropriate application program PO is stored at the processor 26.

In addition, the first signals S1 can contain live image data LD which are derived by the remote-control electronics 12 from live image signals LS which the remotely controlled object 4 transmits to the transmitter 6. By means of these live image data LD, live images can be generated on the computer display 24, which live images for example depict a working area on the object 4 and thus facilitate a better view for the user.

The second signals S2, which are transmitted from the processor 26 to the remote-control electronics 12, can in addition contain control data SD which trigger automated or semi-automated control manoeuvres on the transmitter 6. To this end, the different control manoeuvres are stored in the processor 26 within an appropriate application program PS. This application program PS here facilitates also the uploading of further control data SD via the Internet connection 36.

In addition, the second signals S2 can contain information data ID which serve for adjusting at least one changeable value of the transmitter 6. The information data ID can here for example serve for adjusting a transmission performance or the transmission frequency of the transceiver unit 14. To this end, an appropriate application program PI is stored on the processor 26. This application program PI here facilitates also the uploading of further control data ID via the Internet connection 36.

The method for the operation according to the invention of the remote-control arrangement is described hereinafter with reference to the flow diagram according to FIG. 2:

According to this diagram, by fixing the portable computer 22 to the housing 8 of the transmitter 6 in a first step ST1 a bidirectional data connection is established between the remote-control electronics 12 of the transmitter 6 and the processor 26 of the portable computer 22 via one of the standard interfaces 30A; 30B.

In a second step ST2, the first signals S1 are then transmitted from the remote-control electronics 12 to the processor 26 and in a third step ST3 the second signals S2 are transmitted from the processor 26 to the remote-control electronics 12. The steps ST2 and ST3 can here take place both one after another and in parallel.

As can be learned from FIG. 2, the first signals S1 contain optionally the image data BD for visualising the control-relevant data on the computer display 24, the device data GD for the functional analysis of the transmitter 6, the object data OD for the functional analysis of the remotely controlled object 4 and/or the live image data LD for reproducing live images of a working area on the computer display 24.

The second signals S2, also transmitted via the bidirectional interface 30A, 30B, can furthermore contain the image data ID for adjusting the transmitter 6 or the control data SD for the automated control of the object 4.

Attention is drawn to the fact that all above described elements and characteristics of the various embodiments of the subject-matter according to the invention can be exchanged or combined among themselves, inasmuch as an exchange or a combination thereof is not excluded for technical reasons.

The invention claimed is:

1. A handheld remote-control arrangement for remotely controlled objects, comprising:

a handheld transmitter which has a housing on which multiple adjustable-position operating elements for the input of control commands are held and in which remote-control electronics are accommodated, by means of which control commands input via the operating elements can be converted into signals, which can be emitted to control the objects; and a display held on the housing for displaying control-relevant information, wherein the display is formed by a computer display of a portable computer produced separately from the transmitter and a standard interface, via which the portable computer can be detachably connected to the remote-control electronics of the transmitter, is provided on the housing, wherein the remote-control arrangement as a whole is handheld, wherein the standard interface is configured to be bidirectional in such a manner that first signals are transmitted from the transmitter to a processor of the portable computer and second signals are transmitted from the processor of the portable computer to the transmitter, wherein the first signals contain image data in a common graphic standard for visualising the control-relevant data of the transmitter on the computer display, and contain device data of the transmitter for the processor of the portable computer to perform an analysis of settings or of functionality of the transmitter, and wherein the second signals contain information data for adjusting at least one changeable value of the transmitter.

2. The handheld remote-control arrangement according to claim 1, wherein the second signals contain control data for controlling the remotely controlled obj ect.

3. The handheld remote-control arrangement according to claim 1, wherein the standard interface has a plug-in connection.

4. The handheld remote-control arrangement according to claim 1, wherein the standard interface is designed to be wireless.

5. The handheld remote-control arrangement according to claim 1, wherein the remote-control electronics of the transmitter have, in addition to a releasable connection with the portable computer, a fixed connection with a stationary display which is installed permanently in the housing.

6. The handheld remote-control arrangement according to claim 1, wherein on the housing is provided a holder for the releasable fastening of the portable computer.

7. A method for operating the handheld remote-control arrangement according to claim 1, the method comprising:

a first step of fastening the portable computer to the housing of the transmitter and establishing a bidirectional data connection via the standard interface between the remote-control electronics of the transmitter and the processor of the portable computer.

8. The operational method according to claim 7, further comprising a second step of transmitting the first signals from the remote-control electronics to the processor and a third step of transmitting the second signals from the processor to the remote-control electronics.

9. The operational method according to claim 8, further comprising the step of generating a visualisation of control-relevant data on the computer display by the image data created in the graphic standard.

10. The operational method according to claim 8, further comprising the step of carrying out the analysis of settings or of functionality of the transmitter at the processor of the portable computer by the device data of the transmitter contained in the first signals.

11. The operational method according to claim 8, further comprising the step of carrying out a functional analysis of the remotely controlled object at the processor of the portable computer by object data contained in the first signals.

12. The operational method according to claim 8, wherein further comprising the step of generating live images captured at the remotely controlled object on the computer display by live image data contained in the first signals contain the live image data by means of which live images captured at the remotely controlled object are generated on the computer display.

13. The operational method according to claim 8, further comprising a step of undertaking settings on the transmitter or on the remote-controlled object by the information data contained in the second signals.

14. The operational method according to claim 8, further comprising the step of undertaking a control of the remotely controlled object by control data contained in the second signals.

15. A computer program product embodied on a non-transitory computer readable medium to be stored on a portable computer, comprising computer-executable program code instructions for, when executed on the portable computer, controlling the operational method according to claim 7.

16. A handheld and/or portable remote-control arrangement for remotely controlled objects, comprising:

a handheld transmitter which has a housing on which multiple adjustable-position operating elements for the input of control commands are held and in which remote-control electronics are accommodated, by means of which control commands input via the operating elements can be converted into signals, which can be emitted to control the objects; and a display held on the housing for displaying control-relevant information, wherein the display is formed by a computer display of a portable computer produced separately from the transmitter and a standard interface, via which the portable computer can be detachably connected to the remote-control electronics of the transmitter, is provided on the housing, wherein the standard interface is configured to be bidirectional in such a manner that first signals are transmitted from the transmitter to a processor of the portable computer and second signals are transmitted from the processor of the portable computer to the transmitter, wherein the first signals contain image data in a common graphic standard for visualizing control-relevant data on the computer display, and device data of the transmitter so that an analysis of settings or of functionality of the transmitter can be carried out at the processor of the portable computer, and wherein the second signals contain control data for controlling the remotely controlled object, and information data for adjusting at least one changeable value of the transmitter.

17. The handheld and/or portable remote-control arrangement according to c1aim 16, wherein the second signals contain control data of control manoeuvers being stored on the portable computer.

* * * * *